US008960563B1

(12) United States Patent
Perten et al.

(10) Patent No.: US 8,960,563 B1
(45) Date of Patent: Feb. 24, 2015

(54) SYSTEM AND METHOD FOR FREIGHT REFRIGERATION POWER CONTROL

(75) Inventors: Herbert Perten, Suffern, NY (US); Timothy Slifkin, Morristown, NJ (US)

(73) Assignee: Startrak Information Technologies, LLC, Rochelle Park, NJ (US)

( * ) Notice: Subject to any disclaimer, the term of this patent is extended or adjusted under 35 U.S.C. 154(b) by 186 days.

(21) Appl. No.: 12/707,666

(22) Filed: Feb. 17, 2010

Related U.S. Application Data

(63) Continuation of application No. 12/103,629, filed on Apr. 15, 2008, now abandoned.

(60) Provisional application No. 61/153,287, filed on Feb. 17, 2009.

(51) Int. Cl.
*G05D 23/00* (2006.01)

(52) U.S. Cl.
USPC ..... 236/51; 62/244; 62/239; 340/584; 340/585

(58) Field of Classification Search
CPC ..... F24F 2011/0068; F24F 2011/0072; B60H 1/32
USPC ..... 62/239, 244; 236/51; 340/584, 585
See application file for complete search history.

(56) References Cited

U.S. PATENT DOCUMENTS

| | | | | |
|---|---|---|---|---|
| 3,871,443 | A * | 3/1975 | Jones | 165/11.1 |
| 6,863,222 | B2 * | 3/2005 | Slifkin et al. | 236/51 |
| 7,848,852 | B2 * | 12/2010 | Sakae et al. | 700/276 |
| 2007/0245755 | A1 * | 10/2007 | Galvez-Ramos | 62/235.1 |

* cited by examiner

*Primary Examiner* — Mohammad M Ali
*Assistant Examiner* — Raheena Rehman
(74) *Attorney, Agent, or Firm* — Drinker Biddle & Reath LLP

(57) ABSTRACT

A mobile refrigerator unit is operated remotely via wireless technology using a system with a local maintenance switch. A local override switch turns the refrigerator unit on and off, but keeps it on in the event of failure of the maintenance switch.

3 Claims, 2 Drawing Sheets

SYSTEM AND METHOD FOR FREIGHT REFRIGERATION POWER CONTROL

RELATED APPLICATIONS

This application is a continuation of U.S. application Ser. No. 12/103,629 filed 15 Apr. 2008, which application is incorporated herein as if fully recited herein. This application also claims the benefit of U.S. Provisional Application No. 61/153,287 filed 17 Feb. 2009.

FIELD

This invention relates to remote monitoring and control of mobile refrigeration units, and particularly for railroad cars, although the system of the aforementioned patent is applicable to refrigeration trucks and other mobile units.

BACKGROUND

U.S. Pat. No. 6,863,222, assigned to the same assignee as the present application, discloses a local power switch which, when turned off, completely disables a so-called reefer (mobile refrigeration) unit, and a secondary remote switch to turn the mobile refrigeration unit on and off. U.S. application Ser. No. 12/103,629 filed 15 Apr. 2008 discloses remote control of the power applied to mobile refrigeration units by a wireless telematics system, while still allowing for local control when desired. These arrangements are suitable for many applications but exhibit some shortcomings.

An object of this system of invention is to improve the system of the aforementioned patent and applications.

SUMMARY OF EMBODIMENTS OF THE INVENTION

According to an embodiment of the invention, a remotely controlled maintenance switch allows a local switch to turn the reefer on and off, but the system always maintains power to the reefer even if the local switch was set in an off position.

The various features of novelty that characterize the system of the invention are pointed out in the claims forming a part of this specification. Other objects and advantages of the system of the invention will be evident from the following detailed description when read in light of the attached drawings.

DETAILED DESCRIPTION OF PREFERRED EMBODIMENTS

Figure 1:
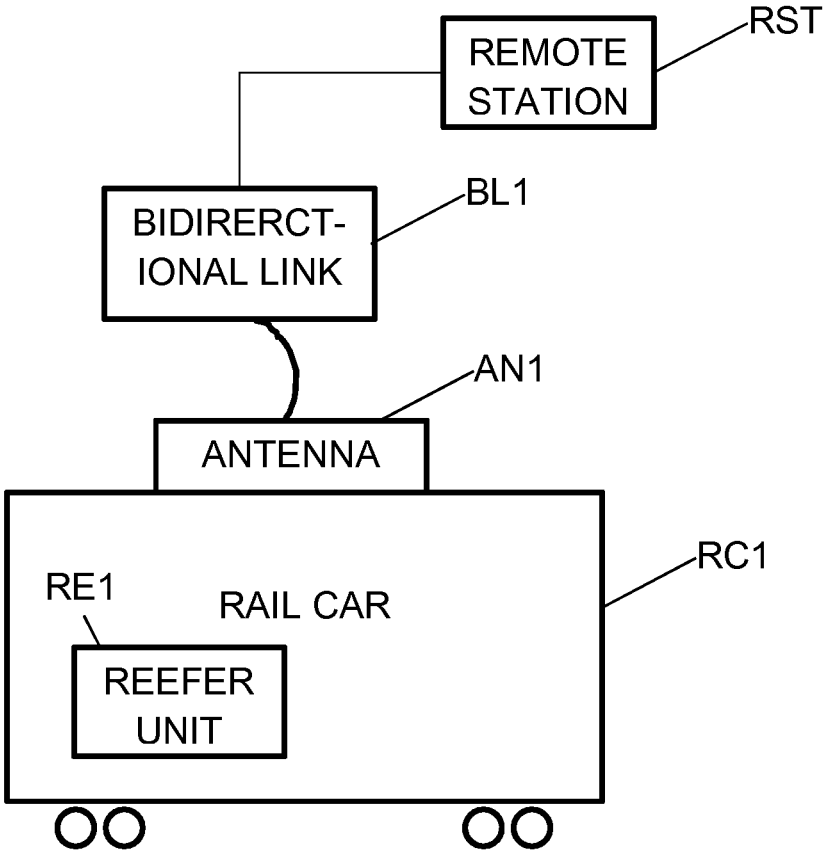
FIG. 1 is a block diagram of a system embracing the structure shown in FIG. 2 and embodying features of the invention.

FIG. 1 illustrates a system for controlling a so-called reefer unit, i.e. mobile refrigeration unit RE1 on a railroad refrigeration car RC1. According to various embodiments the car RC1 is a motor truck or other mobile device carrying the refrigeration unit. A control unit in the car monitors and controls the temperature and operation of the refrigeration unit. An antenna AN1 places the control unit into communication with a remote station RST1 via a bi-directional link BL1. The remote station RST1 transmits instructions, via the bi-directional link BL1 and the antenna ANI, to the control unit to establish desired temperature and other conditions in the refrigeration unit RE1.

According to various embodiments, the bi-directional link BL1 is a wireless link, and/or a station-to-station link, and/or one communicating with another station and/or via other wireless links or land lines, the Internet, or a combination of these, with the remote station RST1. According to yet another embodiment of the system, the bi-directional link BL1 includes one or more satellites, alone or in combination with other links. In effect the bi-directional link BL1 represents a communication system generally. According to an embodiment, the rail car RC1 is one of many, each carrying an antenna for allowing the rail car to communicate with the remote station RST1 via the bidirectional link BL1. The remote station may thus control refrigeration in a fleet of vehicles, rail or truck or even ships.

The remote station RST1 remotely controls the power to the refrigeration unit RE1 via the bi-directional link BL1, the antenna AN1, and the control unit CU1.

Figure 2:
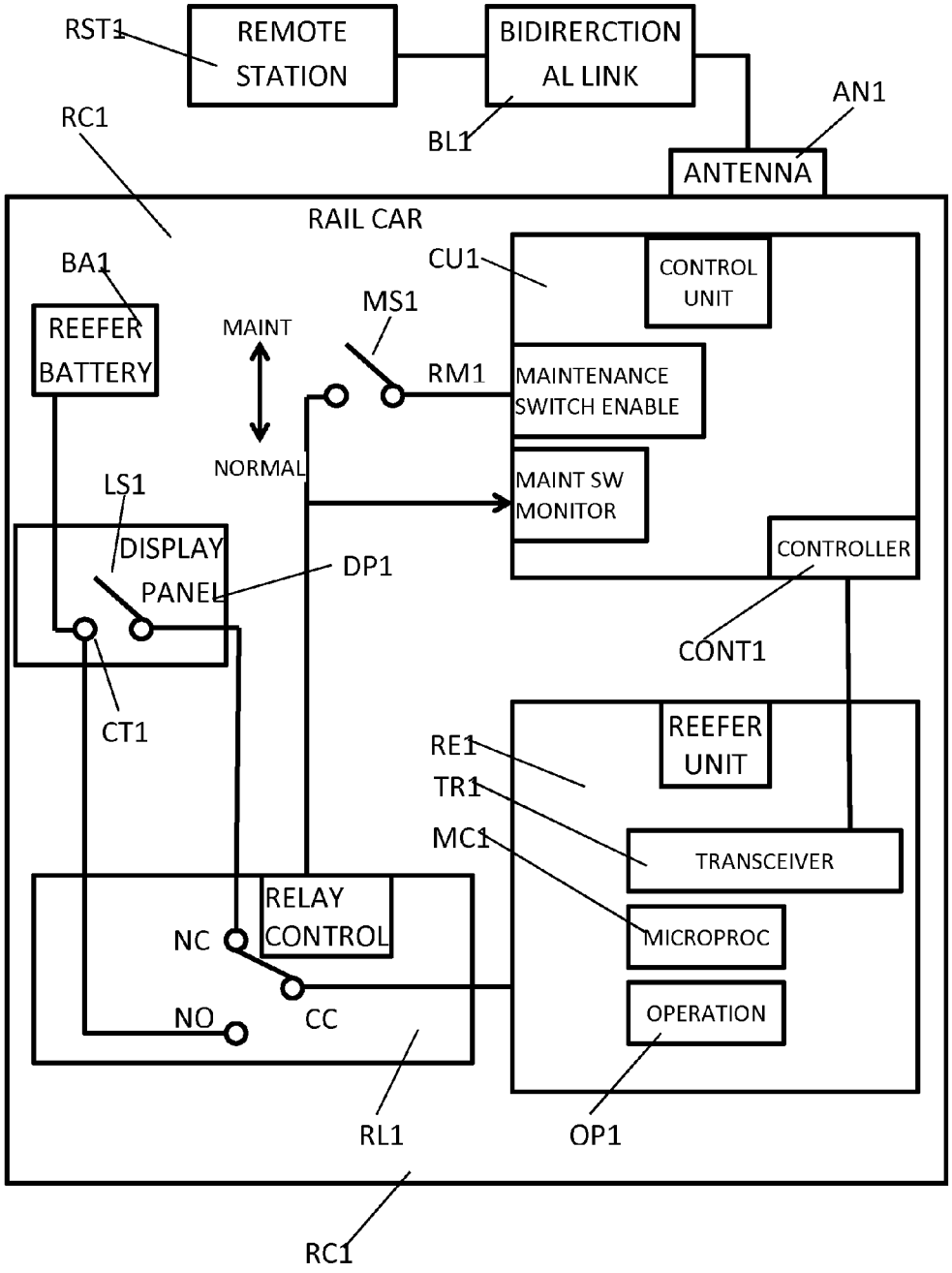
FIG. 2 is a block diagram of a reefer control arrangement embodying features of the present invention.

FIG. 2 illustrates details of the system of FIG. 1. In FIG. 2, the antenna AN1 on the car RC1 receives and transmits data from and to the remote station RST1. In the car RC1, a control unit CU1 receives and transmits data to and from the remote station RST1 via the bidirectional link BL1 and the antenna AN1, and applies it to a transceiver TR1 in a refrigeration unit RE1. The remote station RST1 normally controls the temperature and other operating characteristics of the refrigeration unit RE1.

Maintenance Switch Closed (Normal/Remote Control)

When closed, maintenance switch MS1 causes the control unit CU1 to issue a signal RM1 to energize a relay control RL1 and connect a common contact CC with a contact NO. In this energized condition the relay control RL1 connects a battery BA 1 with the reefer unit RE1, via a contact CT1 of a local switch LS1 in a local display panel DP1. The battery BA1 then supplies power to the reefer unit regardless of the position of the local switch LS1. The control unit CU1 receives the status of the maintenance switch via a feedback signal at a maintenance switch monitor input and forwards the feedback signal to the remote station RST1.

Maintenance Switch Opened (Maintenance Mode/Safety Setting/Local Control)

If the maintenance switch MS1 is open, the signal RM1 fails to appear at the relay control RL1. The latter then assumes its unenergized status and the relay armature connects the common contact CC with the contact NC. This places the switch LS1 in series between the battery BA1 and the reefer unit RE1. Now, a maintenance person or other local workman can control the power to the reefer unit RE1 as needed. Typically, a site operator would turn the switch LS1 OFF prior to unloading the refrigeration car. The site operator would turn it ON prior to loading the car so that it will be cool enough to refrigerate the cargo when it is loaded.

Opening of the Maintenance Switch MS1 prevents relay RL1 from being energized. This introduces a safe mode for technicians servicing the equipment, in that the system cannot be turned on remotely. It also provides for a way of turning off the system locally should it be powered on remotely.

OPERATION

In its energized (NO) position, relay control CL1 applies power directly to the reefer unit RE1 regardless of the position of switch LS1. Assuming that the maintenance switch MS1 is closed (i.e., normal operation), this allows control unit CU1 to power the reefer unit RE1 on and off as desired by means of signal RM1 even if switch LS1 is open. Since the control unit CU1 is part of a wireless system, by extension, the reefer power can be controlled from a remote station RST1.

Power is applied to the reefer unit through the common contact CC of relay RL1. In its de-energized (NC) position, the relay control RL1 provides a power path to the reefer RE1 from the existing local switch LS1 mounted on the display panel of the reefer unit RE1. Thus, when switch LS1 is closed, the reefer unit RE1 is powered on; when switch LS1 is opened, the reefer is powered off.

With the switch MS1 closed, the reefer unit RE1 may be started remotely to be checked-out ("pre tripped") and pre-cooled, prior to loading. This is vital in grocery and dairy distribution centers, where produce is loaded centrally and distributed to stores, where remotely turning off the units is less important (it can be done locally). So the system is a significant improvement in that operationally it serves an important feature set without any consequences of failure and at much lower cost. There is never a need to turn off the unit remotely for customers who operate this way.

The present system always maintains power to the reefer RE1 if it was turned on locally by closing the switch LS1. If the relay control RL1 fails by staying in its normally open position NO, power is applied to the reefer RE1 from the +12 v supply of battery BA1 via the contact CT1. If the relay control CL1 fails in its normally closed position NC, current flows to the reefer RE1 through the local power switch L51. Thus, when the operator has closed the local switch LS1, the reefer RE1 will continue to operate even if a failure causes the system to lose control of the relay.

In its de-energized NC position, the relay RL1 provides a power path to the reefer unit RE1 from a local switch LS1, mounted on the display panel DP1 of the reefer unit RE1. Thus, when switch LS1 is closed, the reefer unit RE1 is powered on; when LS1 is opened, the reefer unit RE1 is powered off.

In its energized (NO) position, relay RL1 applies power directly to the reefer unit RE1 regardless of the position of switch LS1. When a maintenance switch MS1 is closed, this allows Control Unit CU1 to power the reefer unit RE1 on and off as desired by means of signal RM1 even if LS1 is open. The control unit CU1 is part of a wireless system and connected to the antenna AN1, the reefer unit power can be controlled from a remote location communicating with the antenna AN1.

Opening of the maintenance switch MS1 prevents relay RL1 from being energized and places the relay RL1 in the NC position. This introduces a safe mode for technicians to service the equipment, because the system cannot be turned on remotely. It also provides for a way of turning off the system locally should it be powered on remotely.

The status of MS1 is fed back to the control unit CU1 for reporting back to a remote operator that the switch MS1 has been activated.

The transceiver TR1 forms part of the reefer unit RE1 and senses the conditions of operation in the operation unit OP1 within the reefer unit. A microcontroller MC1 in the reefer unit RE1 senses conditions, such as temperature, in the operation unit OP1 and other parts of the reefer unit. The transceiver TR1 transmits the conditions sensed to the controller CONT1 in the control unit CU1. The controller CONT1 then transmits these sensed conditions to the remote station RST1 via a transceiver and the antenna AN1.

The system according to an embodiment of the present invention always maintains power to the reefer if it was turned on locally. If the relay RL1 fails in its normally open position NO, power will be applied to the reefer from the +12 v supply; if the relay fails in its normally closed position NC, power will be applied to the reefer unit RU1 through the reefer's local power switch LS1. Thus, when the operator has turned ON the reefer locally, the reefer will continue to operate even if a failure causes the system to lose control of the relay RL1.

Thus the control unit CUI allows a local maintenance person or site operator at the car RC1 to turn the reefer (refrigeration) unit RE1 on or off. When the remote station RST1 turns the refrigeration unit RE1 off, the local power switch LS1 allows the local maintenance person to take ultimate authority to turn the refrigeration unit RE1 on and off. The local power switch LS1 then, when turned off, completely disables mobile refrigeration unit RE1, and when turned, on permits operation of the unit.

The system overcomes the effect of a workman inadvertently leaving the local switch LS1 of the reefer unit RE1 in its OFF position, which would otherwise would leave the reefer unit without power and render the reefer unit RE1 inoperative. It surmounts the effect of requiring an operator to be dispatched to the car to return the switch LS1 to its off position. The control unit CUI provides an alternative path for power to the reefer unit RE1, through the normally open contact NO of the relay RL1. The switch/relay RL1 is controlled from the remote station RST1 with the remote bi-directional link BL1 and antenna ANI, and can provide power to the reefer unit RE1 regardless of the state of the local switch LS1.

The difference between the aforementioned patent and embodiments of the invention reside in part in the following.

Both systems offer the ability to remotely turn on the reefer RE1 with the local switch LS1 off. An embodiment of the present invention introduces the arrangement in which a maintenance switch MS1 can prevent the refrigeration from being turned off remotely like the aforementioned patent. This has the advantage of increased reliability, as any failure to any components of the system result in no interruption to the power of the reefer system. In the aforementioned patent a component failure may cause the reefer to lose power.

In grocery and dairy distribution centers, where produce is loaded centrally and distributed to stores, remotely turning off the units is less important (it can be done locally). So the system is set without any consequences of failure. Customers who operate this way cannot turn off remotely if the maintenance switch MS1 is on.

While embodiments of the system of the aforementioned patent have been described in detail, it will be evident to those skilled in the art that the system of the aforementioned patent may be embodied otherwise.

What is claimed is:

1. A mobile refrigeration system, comprising:

a car;

a refrigeration unit in said car and having a plurality of operating conditions including temperature;

a refrigeration-unit-energizing power source in said car that is connected to and provides power to the refrigeration unit;

a refrigeration-unit operation unit controller in said car;

a remote operating-condition manager coupled to said operation unit controller, and located at a remote station remote from said car, that sends remote control commands to the car;

a local switch that is connectable in series between the power source and the refrigeration unit;

a power relay control connected in series between the local switch and the refrigeration unit;

an on-off maintenance switching arrangement connected in series between said operation unit controller and said power relay control;

wherein:

the power relay control selectively: a) connects and enables the local switch; and b) bypasses and disables the local switch;

while the local switch is connected and enabled:

when the local switch is in an on configuration, the power source provides power to the refrigeration unit;

when the local switch is in an off configuration, the power source does not provide power to the refrigeration unit;

the power relay control, if and only if the on-off maintenance switching arrangement is in an on configuration, receives the remote control commands;

while the local switch is bypassed and disabled:

the provision of the power source to the refrigeration unit is not affected by the local switch; and the power relay control, if and only if the on-off maintenance switching arrangement is in an on configuration: i) receives the remote control commands, and ii) connects and disconnects the power source and the refrigeration unit in response to the remote control commands.

2. The system according to claim 1, further comprising:

a maintenance switch monitor that provides a status of the maintenance switch to the remote station.

3. The system according to claim 1, further comprising:

an antenna associated with the car that receives the remote control commands.

* * * * *